US006125664A

United States Patent [19]

Browder, Jr.

[11] Patent Number: 6,125,664

[45] Date of Patent: Oct. 3, 2000

[54] BRASSIERE, BRASSIERE BLANK AND METHODS OF MAKING SAME

[76] Inventor: George Alexander Graham Browder, Jr., 150 Staffordshire Ct., Winston-Salem, N.C. 27104

[21] Appl. No.: 09/300,491

[22] Filed: Apr. 28, 1999

[51] Int. Cl.[7] ..... A41B 9/16

[52] U.S. Cl. ..... 66/176; 450/92; 66/196

[58] Field of Search ..... 66/176, 171, 177, 66/8, 172 R, 175, 196, 197; 450/156, 8, 10, 30, 31, 37, 92; 2/67, 104, 103, 109

[56] References Cited

U.S. PATENT DOCUMENTS 3,772,899 11/1973 Novi ..... 66/176
4,531,525 7/1985 Richards .
4,682,479 7/1987 Pernick ..... 66/176
5,479,791 1/1996 Osborne ..... 66/176
5,553,468 9/1996 Osborne .
5,592,836 1/1997 Schuster et al. .
5,850,745 12/1998 Albright ..... 66/176
5,946,944 9/1999 Osborne ..... 66/176

*Primary Examiner*—Danny Worrell

[57] ABSTRACT

Methods of manufacturing a brassiere, a blank for the manufacture of the brassiere and the brassiere and blank so produced are provided. The brassiere has an outer fabric and an inner fabric. The yarn and knit stitches for the inner fabric are selected to provide comfort to the wearer. The blank is formed in a generally cylindrical shape with a bottom welt band seamlessly joined to a bottom edge of an upper torso part formed in the outer fabric and to a bottom edge of an upper torso part formed in the inner fabric. Front and rear strap portions are formed in the upper torso parts.

20 Claims, 1 Drawing Sheet

BRASSIERE, BRASSIERE BLANK AND METHODS OF MAKING SAME

BACKGROUND OF INVENTION

1. Field of the Invention

The present invention relates to a brassiere, a blank for making the brassiere, and methods for making the brassiere and the blank made on a circular knitting machine. More particularly, the present invention relates to a brassiere formed from a blank of a circular knitting machine in which the brassiere has an inner fabric and an outer fabric in which the inner fabric provides comfort to the body of the brassiere wearer.

2. Description of the Prior Art

The use of generally cylindrical blanks in the manufacture of brassieres is known. For example, U.S. Pat. No. 4,531,525 describes the use of a circular knitting machine to produce a cylindrical blank having a pair of welt bands at opposite ends of the blank. A front torso portion is knit to one of the welts. A pair of breast cups is formed with knitting courses that use different stitches in the front torso portion. A strap and rear torso portion is knit to the front torso portion and to the other welt. To assemble the brassiere, the cylindrical blank is slit longitudinally and laid flat. The flat blank is then cut along a neck line and armhole lines to define straps and the rear torso portion. The blank is then folded and the two welts and the front and rear portions are sewn together. Such a brassiere is formed with a single fabric with yarns and knit stitches selected for strength and support without regard for bodily comfort of the wearer.

U.S. Pat. Nos. 5,553,468 and 5,592,836 describe cylindrical blanks for the manufacture of brassieres. Each blank uses a single welt at one end of the blank to which is knitted the front and rear torso portions. To assemble the brassiere, neck and armhole areas are removed from the blank to define front and rear strap portions in the front and rear torso portions. The front and rear straps are sewn together to complete the formation of the brassiere. Again, such a brassiere is formed with a single fabric with yarns and knit stitches selected for strength and support without regard for bodily comfort of the wearer.

SUMMARY OF THE INVENTION

It is an object of the present invention to provide a brassiere having an inner fabric that is comforting to the wearer's body.

It is another object of the present invention to provide a cylindrical blank for the manufacture of a brassiere with inner and outer fabrics.

It is still another object of the present invention to provide a method of making a cylindrical blank for a brassiere with inner and outer fabrics.

It is a further object of the present invention to provide a method of making a brassiere with inner and outer fabrics.

These and other objects of the present invention will be understood by a brassiere according to the present invention has a torso encircling turned welt and a torso encircling part that is integrally and seamlessly joined to the bottom welt. The torso part is formed of an inner fabric and an outer fabric that are knit to one another. Right and left straps are formed in the upper portion of the torso part. The outer fabric is formed with yarn of nylon alone, or combinations of nylon and cotton, using one or more knit stitches that can provide strength, support, or aesthetic properties in specific areas. The inner fabric is formed with yarns and one or more knit stitches, that are selected for softness, comfort, and moisture wicking properties.

A blank for the manufacture of a brassiere according to the present invention has a turned welt, an inner fabric and an outer fabric. Each of the inner and outer fabrics has a torso part that includes a pair of front and rear strap portions and a bottom edge. The bottom edge is seamlessly joined to the turned welt in a manner to form the blank in a generally cylindrical seamless shape.

A method of forming a blank for the manufacture of a brassiere according to the present invention comprises the steps of forming a generally cylindrical turned welt, forming first and second generally cylindrical upper torso parts that each have a bottom edge seamlessly joined to the turned welt, and forming a pair of front straps and a pair of rear straps in each of the upper torso parts.

A method of making a brassiere according to the present invention comprises the steps of first forming a generally cylindrical blank. The blank is formed with first and second upper torso parts. Each of the upper torso parts has a bottom edge that is seamlessly joined to a turned welt. A pair of front and rear straps are formed in each of the upper torso parts to define a neckline and armholes. Areas of each of the upper torso parts adjacent to the straps are cut and removed to define the neckline and armholes. The first and second upper torso parts are tacked together in a manner that the first and second torso parts become inner and outer torso parts of the brassiere. The distal ends of the straps are joined together to form right and left straps.

BRIEF DESCRIPTION OF THE DRAWINGS

Other and further objects, advantages and features of the present invention will be understood by reference to the following specification in conjunction with the accompanying drawings, in which like reference characters denote like elements of structure.

DESCRIPTION OF PREFERRED EMBODIMENTS

Figure 1:
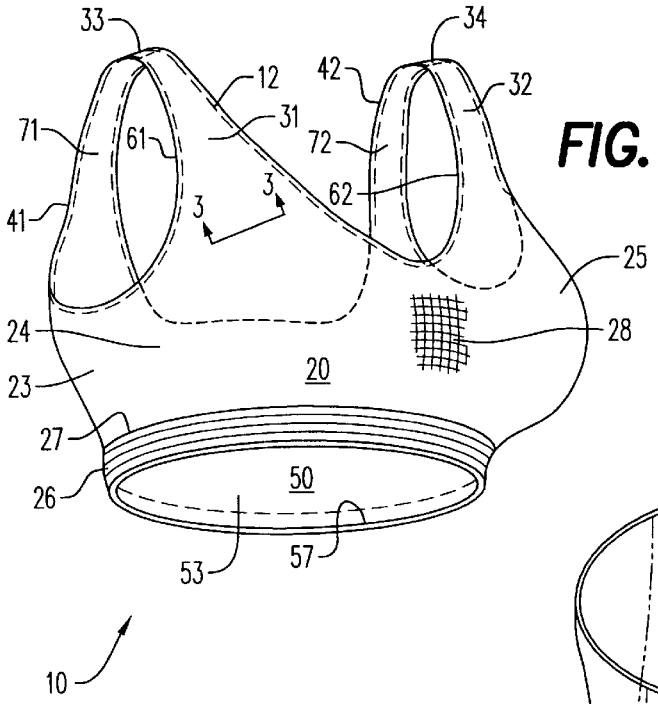
FIG. 1 is a perspective view of a brassiere according to the present invention.
Figure 3:
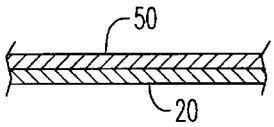
FIG. 3 is an enlarged cross-sectional view taken along line 3—3 of FIG. 1.

Referring to drawings and, in particular, FIGS. 1 and 3, there is provided a brassiere according to the present invention generally represented by numeral 10. Brassiere 10 is formed of an outer fabric 20, an inner fabric 50, and a turned welt or band 26.

Outer fabric 20 has an upper torso part 23. Upper torso part 23 has a lower edge 27 that is integrally joined to turned welt 26 in a seamless manner.

Upper torso part 23 preferably has formed therein a breast cup or area 24. Upper torso part 23 also preferably has a first or right front strap or strap portion 31, a second or left front strap or strap portion 32, a first or right rear strap or strap portion 41 and a second or left rear strap or strap portion 42. In a preferred embodiment, upper torso part 23 has a pair of breast cups or areas 24 and 25. In this embodiment, preferably upper torso part 23 has a center gathered panel area 28 located between breast cups or areas 24 and 25. However, breast cups may be made without gathered panel area 28.

Outer fabric 20 is preferably made of flat nylon ground yarn and a cotton and/or an elastomeric yarn, such as, nylon yarn. The flat nylon yarn is used because it has no stretch. The outer fabric preferably includes an elastomeric yarn, such as spandex. The combination of yarns forms a pattern that is in the range about 40/1's to about 60/1's cotton count or about 40 to about 120 denier, preferably about 80 to about 120 denier. The flat nylon ground yarn is about 20 to about 40 denier, preferably about 20 denier. The knit stitches can be any conventional knit stitches, such as, for example, plain, tuck, or float.

Inner fabric 50 has an upper torso part 53. Upper torso part 53 has a lower edge 57 that is integrally joined to turned welt 26 without any seam. Upper torso part 53 has a first or right front strap 61, a second or left front strap 62, a first or right rear strap 71, and a second or left rear strap 72.

Inner fabric 50 is made of either nylon microfiber having about 40 to about 120 denier range or about 40/1's to about 60/1's cotton yarn. Such yarn provides softness, comfort and desired wicking properties. Inner fabric has a knit construction. The knit construction may be any combination of conventional knit stitches with the potential additional yarns or knit constructions added in strategically engineered areas to provide support or lift. Such strategic areas are, for example, under the breast cups 24 and 25.

Outer fabric 20 is formed with yarns using one or more knit stitches. Outer fabric 20 provides a desired aesthetics. By way of example only, outer fabric 20 may have lines, a floral pattern, may be shear, or have any combination of consumer desired visual presentations.

Inner fabric 50 is formed with yarns selected for softness, comfort and wicking properties, using knit stitches to provide bodily comfort and support to the wearer. Outer fabric 20 and inner fabric 50 are formed from a continuous or integral cylindrical blank preferably from a circular knitting machine.

A seam 33 joins right front straps 31 and 61, and right rear straps 41 and 71, together. A seam 34 joins left front straps 32 and 62 and left rear straps 42 and 72 together. Outer fabric 20 and inner fabric 50 are joined together with tacking 12.

Turned welt 26 forms a band that connects together outer fabric 50 and inner fabric 20. The band is a waistband for brassiere 10. Turned welt or waistband 26 is preferably an elastomeric yarn or material. More preferably, turned welt 26 is made of a combination of nylon covered spandex and nylon. Most preferably, turned welt 26 is made of about 265 to about 420 denier nylon covered spandex and nylon. Such a high denier spandex is preferred in order to make certain that brassiere 10 stays in place on the wearer's body.

Brassiere 10 is formed with a conventional knitting machinery having a knitting course program. The program provides one or more stitch types to produce turned welt 26, and upper torso parts 23 and 53.

Figure 2:
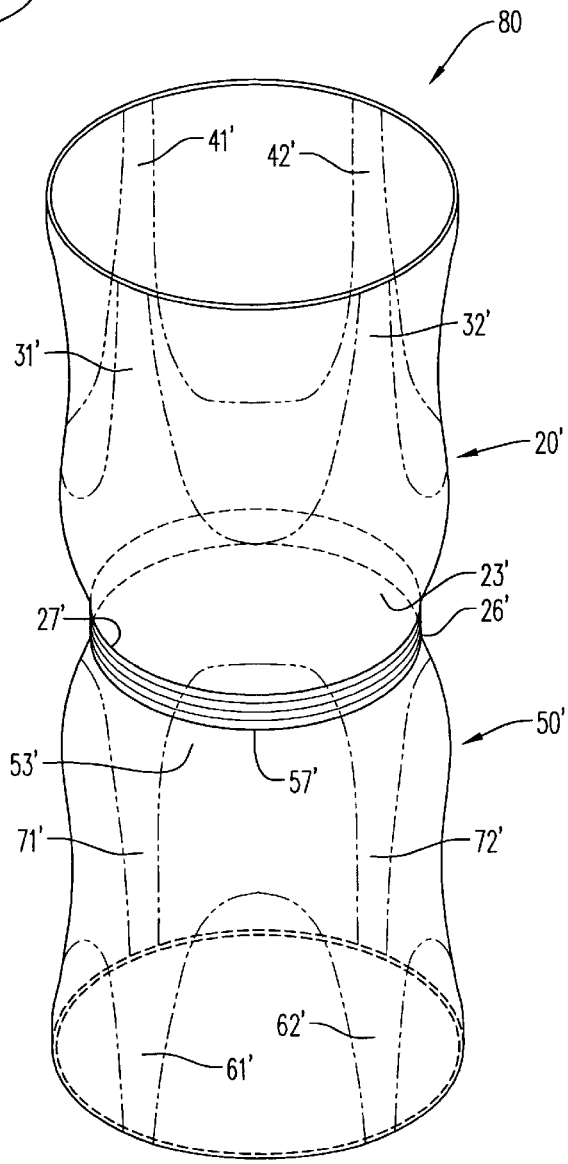
FIG. 2 is a perspective view of a generally cylindrical blank according to the present invention for use in the manufacture of the brassiere of FIG. 1.

Referring to FIG. 2, brassiere 10 is produced from a blank 80 that is formed by a high speed circular knitting machine. Blank 80 is a generally cylindrical tube having portions that, upon manufacture of brassiere 10, correspond to portions of the brassiere. For that reason, reference characters corresponding to those used above with reference to FIGS. 1 and 3, will be applied in FIG. 2 with a prime notation.

Blank 80 has an outer fabric 20' and an inner fabric 50'. Outer fabric 20' has an upper torso part 23', a pair of front straps 31' and 32', and a pair of rear straps 41' and 42'. Upper torso part 23' has a lower edge 27' that is seamlessly joined to turned welt 26'. Inner fabric 50' has an upper torso part 53', a pair of front straps 61' and 62' and a pair of rear straps 71' and 72'. Upper torso part 53' has a lower edge 57' that is seamlessly joined to turned welt 26'.

Blank 80 is formed by a series of circular knitting courses. The courses for turned welt 26' preferably involve a course program that has miss-stitch or float stitch construction. In this construction, loops in certain courses are held without additional yarns being taken and then knit into subsequent courses, thereby gathering the courses together and providing the characteristics of a turned welt.

Upper torso parts 23' and 53' are formed mostly with simple knit constructions, such as plain, tuck, pearl and combinations thereof. Welt knit stitches may suitably be used to provide special features at various locations of blank 80, such as support for a pair of breast areas 24' and 25'.

To manufacture brassiere 10, blank 80 is cut to form upper torso parts 23' and 53' by removing areas adjacent strap portions 31', 41', 32', 42', 61', 71', 62', and 72' thereby defining the neck line and arm holes of brassiere 10. Outer fabric 20' is then drawn over inner fabric 50'. The distal ends of strap portions 31', 41', 61' and 71' are sewn together at seam 33 to form the right strap of brassiere 10. The distal ends of strap portions 32', 42', 62', and 72' are sewn together at seam 34 to form the left strap of brassiere 10. Then, outer fabric 20' and inner fabric 50' are tacked together at tacking 12.

The entire brassiere is made from a continuous integral cylindrical blank that is formed on a high speed circular knitting machine known in the art. However, the use of a double fabric layer, with the inner fabric 50 having certain features that provide softness, and comfort and wicking, that have not been heretofore known. Also, the inner fabric 50 provides fit.

The present invention having been thus described with particular reference to the preferred forms thereof, it will be obvious that various changes and modifications may be made therein without departing from the spirit and scope of the present invention as defined in the appended claims.

What is claimed is:

1. A brassiere formed from an integral circular blank comprising:

a turned welt having a torso encircling shape; and a torso part having an outer fabric and an inner fabric, said outer fabric and said inner fabric each having a torso encircling shape and a lower edge that is seamlessly joined to said turned welt, said outer fabric being formed with one or more types of yarn, using one or more knit stitches, said inner fabric having one or more knit stitches, and being formed with a yarn selected for softness, and wicking of moisture, wherein said outer fabric and said inner fabric form a double layer that provides strength and comfort to the brassiere.

2. The brassiere according to claim 1, wherein said outer fabric includes a nylon ground yarn.

3. The brassiere according to claim 2, wherein said outer fabric further includes an elastomeric yarn.

4. The brassiere according to claim 3, wherein said outer fabric is selected from the group consisting of cotton, nylon, and a combination thereof.

5. The brassiere according to claim 1, wherein said outer fabric is about 80 to about 120 denier.

6. The brassiere according to claim 1, wherein said one or more knit stitches of said outer fabric is selected from the group consisting of plain, tuck, and float.

7. The brassiere according to claim 1, wherein said inner fabric is a microfiber nylon.

8. The brassiere according to claim 7, wherein said inner fabric is about 40 to about 120 denier.

9. The brassiere according to claim 1, wherein said inner fabric is about 40/1's to about 60/1's cotton yarn.

10. The brassiere according to claim 1, wherein said turned welt is formed, at least in part, with elastomeric yarn.

11. The brassiere according to claim 10, wherein said turned welt is about 265 to about 420 denier.

12. The brassiere according to claim 10, wherein said elastomeric yarn is spandex.

13. A single blank for manufacturing a brassiere, said blank comprising:

a turned welt;

an outer fabric; and an inner fabric portion, each of said outer and inner fabrics having an upper torso part that has a bottom edge, and a pair of front straps and a pair of rear straps, wherein said bottom edges of said outer and inner fabrics are seamlessly joined to said turned welt to form a double layer, generally cylindrical seamless shape, said outer fabric being formed with one or more types of yarn, using one or more knit stitches, said inner fabric having one or more knit and wicking of moisture, and wherein said outer fabric and said inner fabric form a double layer that provides strength and comfort to the brassiere.

14. The brassiere according to claim 13, wherein said outer fabric includes a nylon ground yarn, and a yarn that is selected from the group consisting of cotton, nylon, and a combination thereof.

15. The brassiere according to claim 13, wherein said inner fabric is a microfiber nylon.

16. The brassiere according to claim 13, wherein said turned welt is formed, at least in part, with elastomeric yarn that is about 265 to about 420 denier.

17. A single blank for manufacturing a brassiere, said blank comprising:

a turned welt;

an outer fabric; and an inner fabric portion, each of said outer and inner fabrics having an upper torso part that has a bottom edge, and a pair of front straps and a pair of rear straps, wherein said bottom edges of said outer and inner fabrics are seamlessly joined to said turned welt to form a double layer of generally cylindrical seamless shape.

18. The blank according to claim 17, wherein said inner fabric is formed with a yarn selected for softness, comfort and wicking properties, and using one or more knit stitches to provide comfort to the wearer's body.

19. A method of making a generally cylindrical seamless blank for manufacturing a brassiere, said method comprising:

forming a generally cylindrical welt;

forming a first generally cylindrical upper torso part having a bottom edge seamlessly joined to said welt;

forming a second generally cylindrical upper torso part having a bottom edge seamlessly joined to said welt; and forming in each of said upper torso parts a pair of front strap portions and a pair of rear strap portions to define a neckline and armholes.

20. A method of making a brassiere comprising:

forming a generally cylindrical blank by:

forming a generally cylindrical welt;

forming a first generally cylindrical upper torso part having a bottom edge seamlessly joined to said welt;

forming a second generally cylindrical upper torso part having a bottom edge seamlessly joined to said welt; and forming in each of said upper torso parts a pair of front strap portions and a pair of rear strap portions to define a neckline and armholes; and cutting and removing areas of each of said upper torso parts that are adjacent to said strap portions to define said neck line and said arm holes;

tacking the first and second torso parts together in a manner that the first and second torso parts become outer and inner torso parts of the brassiere;

joining the distal ends of said right front strap portions and said right rear strap portions together to form a right strap; and joining the distal ends of said left front strap portions and said left rear strap portions together to form a left strap.

* * * * *